US008109379B2

(12) United States Patent
Sjöström

(10) Patent No.: US 8,109,379 B2
(45) Date of Patent: Feb. 7, 2012

(54) COIN DEPOSIT AND DISPENSING APPARATUS

(75) Inventor: Anders Sjöström, Lund (SE)

(73) Assignee: Scan Coin AB, Malmo (SE)

( * ) Notice: Subject to any disclaimer, the term of this patent is extended or adjusted under 35 U.S.C. 154(b) by 417 days.

(21) Appl. No.: 11/844,415

(22) Filed: Aug. 24, 2007

(65) Prior Publication Data

US 2008/0082207 A1 Apr. 3, 2008
US 2009/0118860 A9 May 7, 2009

Related U.S. Application Data

(60) Provisional application No. 60/840,212, filed on Aug. 25, 2006.

(30) Foreign Application Priority Data

Aug. 25, 2006 (SE) ..... 0601745

(51) Int. Cl.
*G07F 9/00* (2006.01)
*G07F 9/10* (2006.01)

(52) U.S. Cl. ..... 194/215; 194/350

(58) Field of Classification Search ..... 194/215, 194/350; 235/10, 22, 7 A; 463/46, 47; 193/DIG. 1
See application file for complete search history.

(56) References Cited

U.S. PATENT DOCUMENTS 1,885,252 A * 11/1932 Gaisman ..... 235/22
2,519,357 A 8/1950 Daugherty
2,646,805 A 7/1953 Anderson
3,147,839 A 9/1964 White, Jr.
3,196,887 A 7/1965 White, Jr.
3,828,166 A 8/1974 Johansson et al.
4,286,703 A 9/1981 Schuller et al.
4,360,034 A 11/1982 Davila et al.
4,376,442 A 3/1983 Gomez et al.
4,383,540 A 5/1983 DeMeyer et al.
4,541,057 A 9/1985 Hagiwara
4,558,712 A 12/1985 Sentoku et al.
4,595,828 A 6/1986 Lundblad
4,636,947 A 1/1987 Ward
4,733,765 A 3/1988 Watanabe (Continued)

FOREIGN PATENT DOCUMENTS

CA 2 320 646 A1 6/2001

(Continued)

OTHER PUBLICATIONS

International Search Report—PCT/SE2007/000733.

(Continued)

*Primary Examiner* — Mark Beauchaine
(74) *Attorney, Agent, or Firm* — Womble Carlyle Sandridge & Rice, LLP

(57) ABSTRACT

A coin dispensing apparatus has a cabinet housing the apparatus. The apparatus has a controller and at least one dispenser for dispensing coins. The apparatus is for dispensing a specific composition of coins, under control by the controller, from the at least one dispenser to a portable coin receptacle. A closeable dispense space is arranged within the cabinet. The closeable dispense space has an open state which permits reception of the portable coin receptacle to be filled, and a closed state which permits dispensing of the specific composition of coins from the at least one dispenser into the portable coin receptacle while shielding the closeable dispense space from user access during the dispensing.

25 Claims, 11 Drawing Sheets

U.S. PATENT DOCUMENTS

| | | | | |
|---|---|---|---|---|
| 4,744,468 | A | 5/1988 | Goi et al. | |
| 4,964,495 | A | 10/1990 | Rasmussen | |
| 4,988,849 | A | 1/1991 | Sasaki et al. | |
| 4,995,848 | A | 2/1991 | Goh | |
| 5,027,935 | A | 7/1991 | Berg et al. | |
| 5,302,811 | A | 4/1994 | Fukatsu | |
| 5,340,967 | A | 8/1994 | Martin et al. | |
| 5,363,296 | A * | 11/1994 | Fuyama | 705/18 |
| 5,366,407 | A | 11/1994 | Sentoku | |
| 5,467,857 | A * | 11/1995 | Takemoto | 194/206 |
| 5,469,951 | A | 11/1995 | Takemoto et al. | |
| 5,483,047 | A | 1/1996 | Ramachandran et al. | |
| 5,561,281 | A | 10/1996 | Eda et al. | |
| 5,564,546 | A | 10/1996 | Molbak et al. | |
| 5,620,079 | A | 4/1997 | Molbak | |
| 5,662,201 | A | 9/1997 | Gerlier et al. | |
| 5,799,767 | A | 9/1998 | Molbak | |
| 5,830,054 | A | 11/1998 | Petri | |
| 5,883,371 | A | 3/1999 | Meeker | |
| 5,902,178 | A | 5/1999 | Perkitny | |
| 5,909,794 | A | 6/1999 | Molbak et al. | |
| 5,918,720 | A * | 7/1999 | Robinson et al. | 194/206 |
| 5,982,918 | A | 11/1999 | Mennie et al. | |
| 6,039,164 | A * | 3/2000 | Waters et al. | 194/206 |
| 6,080,056 | A | 6/2000 | Karlsson | |
| 6,086,471 | A | 7/2000 | Zimmermann | |
| 6,116,402 | A | 9/2000 | Beach et al. | |
| 6,128,402 | A | 10/2000 | Jones et al. | |
| 6,206,284 | B1 | 3/2001 | Do et al. | |
| 6,264,545 | B1 * | 7/2001 | Magee et al. | 453/3 |
| 6,318,536 | B1 | 11/2001 | Korman et al. | |
| 6,318,537 | B1 | 11/2001 | Jones et al. | |
| 6,349,972 | B1 | 2/2002 | Geiger et al. | |
| 6,371,845 | B1 * | 4/2002 | Ishida et al. | 453/17 |
| 6,484,863 | B1 | 11/2002 | Molbak | |
| 6,494,776 | B1 | 12/2002 | Molbak | |
| 6,502,746 | B1 | 1/2003 | Do et al. | |
| 6,601,045 | B1 | 7/2003 | DePietro et al. | |
| 6,607,124 | B1 | 8/2003 | Junkins et al. | |
| 6,609,604 | B1 | 8/2003 | Jones et al. | |
| 6,637,576 | B1 | 10/2003 | Jones et al. | |
| 6,644,696 | B2 | 11/2003 | Brown et al. | |
| 6,736,251 | B2 | 5/2004 | Molbak | |
| 6,789,732 | B2 | 9/2004 | Dollhopf et al. | |
| 6,854,581 | B2 | 2/2005 | Molbak | |
| 6,896,118 | B2 | 5/2005 | Jones et al. | |
| 6,896,177 | B2 | 5/2005 | Carter | |
| 6,934,688 | B2 | 8/2005 | Carter | |
| 6,976,570 | B2 | 12/2005 | Molbak | |
| 6,981,633 | B2 | 1/2006 | Inoue et al. | |
| 6,983,836 | B2 | 1/2006 | Adams et al. | |
| 6,991,530 | B2 * | 1/2006 | Hino et al. | 453/3 |
| 7,028,827 | B1 | 4/2006 | Molbak et al. | |
| 7,036,651 | B2 | 5/2006 | Tam et al. | |
| 7,073,707 | B2 | 7/2006 | Carter | |
| 7,131,580 | B2 | 11/2006 | Molbak | |
| 7,163,454 | B2 | 1/2007 | Carter | |
| 7,192,341 | B2 | 3/2007 | Takamisawa et al. | |
| 7,213,697 | B2 | 5/2007 | Martin et al. | |
| 7,244,175 | B2 | 7/2007 | Adams et al. | |
| 7,303,119 | B2 | 12/2007 | Molbak | |
| 2002/0019210 | A1 | 2/2002 | Cole | |
| 2002/0111157 | A1 | 8/2002 | Steiber et al. | |
| 2002/0151267 | A1 | 10/2002 | Kuhlin et al. | |
| 2002/0156734 | A1 | 10/2002 | Yamamoto | |
| 2002/0162724 | A1 * | 11/2002 | Hino et al. | 194/215 |
| 2003/0111395 | A1 | 6/2003 | Aas et al. | |
| 2003/0150688 | A1 | 8/2003 | Martin et al. | |
| 2004/0099729 | A1 | 5/2004 | Utz et al. | |
| 2004/0149818 | A1 | 8/2004 | Shepley et al. | |
| 2004/0181481 | A1 | 9/2004 | Carter | |
| 2004/0186937 | A1 | 9/2004 | Jonsson | |
| 2004/0188221 | A1 | 9/2004 | Carter | |
| 2004/0200690 | A1 | 10/2004 | Adams et al. | |
| 2004/0212141 | A1 | 10/2004 | Graef et al. | |
| 2004/0226493 | A1 | 11/2004 | Siemens et al. | |
| 2004/0231956 | A1 | 11/2004 | Adams et al. | |
| 2005/0167482 | A1 | 8/2005 | Ramachandran et al. | |
| 2006/0060363 | A2 | 3/2006 | Carter | |
| 2006/0090909 | A1 | 5/2006 | Carter | |
| 2006/0144670 | A1 | 7/2006 | Gunst et al. | |
| 2007/0069007 | A1 | 3/2007 | Molbak | |
| 2010/0017017 | A1 * | 1/2010 | Adams et al. | 700/223 |

FOREIGN PATENT DOCUMENTS

| | | | |
|---|---|---|---|
| DE | 30 121 243 | | 10/1980 |
| EP | 0 310 452 | | 3/1988 |
| EP | 0 734 001 | | 9/1996 |
| EP | 0 831 431 | A2 | 3/1998 |
| EP | 0 911 769 | | 4/1999 |
| EP | 1 008 965 | A1 | 6/2000 |
| EP | 1 256 915 | A1 | 11/2002 |
| EP | 1 304 664 | | 4/2003 |
| EP | 1 308 908 | | 5/2003 |
| EP | 1 376 488 | A1 | 1/2004 |
| EP | 1 378 869 | | 1/2004 |
| EP | 1 381 000 | A1 | 1/2004 |
| EP | 1 413 993 | | 4/2004 |
| EP | 1 526 483 | A2 | 4/2005 |
| EP | 1 577 846 | A2 | 9/2005 |
| EP | 1 635 300 | A1 | 3/2006 |
| FR | 2 784 772 | | 4/2000 |
| FR | 2 819 332 | | 7/2002 |
| FR | 2 824 165 | | 10/2002 |
| FR | 2 841 024 | | 12/2003 |
| GB | 2415819 | | 1/2006 |
| JP | 52049097 | | 4/1977 |
| JP | 10-79066 | A * | 3/1998 |
| JP | 2004334597 | | 11/2004 |
| JP | 2005-4347 | | 1/2005 |
| JP | 2005208944 | | 8/2005 |
| JP | 2005-235081 | | 9/2005 |
| SE | 504 700 | | 4/1997 |
| SE | 524 041 | | 4/2004 |
| WO | WO 95/30215 | | 11/1995 |
| WO | WO 96/36933 | | 11/1996 |
| WO | WO 97/29444 | | 8/1997 |
| WO | WO 97/43739 | | 11/1997 |
| WO | WO 00/37317 | | 6/2000 |
| WO | WO 00/65546 | | 11/2000 |
| WO | WO 01/54084 | | 7/2001 |
| WO | WO 2004/010367 | | 1/2004 |
| WO | WO 2004/036323 | | 4/2004 |
| WO | WO 2004/081735 | | 9/2004 |
| WO | WO 2004/081885 | | 9/2004 |
| WO | WO 2004/093021 | | 10/2004 |
| WO | WO 2005/104046 | | 11/2005 |
| WO | WO 2006/019917 | | 2/2006 |
| WO | WO 2006/062834 | | 6/2006 |
| WO | WO 2007/034699 | | 3/2007 |
| WO | WO 2007/035420 | | 3/2007 |

OTHER PUBLICATIONS

International Preliminary Report on Patentability—PCT/SE2005/001120—Dated Oct. 10, 2006.

Scan Coin Technical Manual, Cash Deposit System Model CDS 600 & CDS 400, 1991, Table of Contents and pp. 1-3, 7-17, 43, 44 and 49-52.

Product Model No. CDS 760—Cash Deposit System—Brochure.

Product Model No. SC2200—Scan Coin Active 2200 Coin Sorter—Brochure.

English translation of claims as originally filed in corresponding Swedish patent application No. 0601745-3.

Allowed claims from corresponding Swedish patent application No. 0601745-3 (including English translation).

Office Action dated Feb. 9, 2007, from corresponding Swedish patent application No. 0601745-3 (including English translation).

"Reply to Office Action", dated Jun. 1, 2007, filed in corresponding Swedish patent application No. 0601745-3 (including English translation).

Additional "Reply to Office Action", dated May 29, 2009, filed in corresponding Swedish patent application No. 0601745-3 (including English translation).

Machine generated English translation of JP 10-79066.

* cited by examiner

COIN DEPOSIT AND DISPENSING APPARATUS

CROSS-REFERENCE TO RELATED APPLICATIONS

This application claims the benefit of Swedish patent application no. 0601745-3, filed on Aug. 25, 2006 and U.S. provisional patent application No. 60/840,212, filed on Aug. 25, 2006.

INCORPORATION BY REFERENCE

The specification and drawings of Swedish patent application no. 0601745-3, filed on Aug. 25, 2006 and the specification and drawings of U.S. provisional patent application No. 60/840,212, filed on Aug. 25, 2006, are incorporated herein in their entirety, by this reference.

BACKGROUND OF THE INVENTION

The present invention generally relates to cash handling, and more specifically to coin deposit equipment and coin dispensing equipment.

SUMMARY OF THE INVENTION

A first aspect of the present invention is a coin dispensing apparatus comprising a cabinet serving as an apparatus housing for the apparatus, a controller, and at least one dispenser for coins to be dispensed. The apparatus is adapted to dispense a specific composition of coins, under control by the controller, from the at least one dispenser to a portable coin receptacle. The apparatus has a closeable dispense space within the cabinet. The closeable dispense space has an open state which permits reception of the portable coin receptacle to be filled, and a closed state which permits dispensing of the specific composition of coins from the at least one dispenser into the portable coin receptacle while shielding the closeable dispense space from external access during the dispensing.

The closable dispense space reduces the possibilities for an unauthorized person to manipulate the apparatus. This is true during dispensing as well as when the apparatus is not being used, since the active components of the apparatus are housed inside the cabinet. The closable dispense space also renders it more difficult for dust, litter and other foreign matter from entering the interior of the apparatus, which is beneficial from a operational reliability point of view. This in turn reduces the resources needed for maintenance, making the apparatus more economic.

In one or more embodiments, a movable member is provided which defines at least a partial boundary of the closeable dispense space. The movable member being capable of assuming a first position to achieve the open state, and a second position to achieve the closed state.

One or more embodiments may further comprise a locking mechanism coupled to the controller and associated with the movable member. The locking mechanism is adapted, under control by the controller, to selectively prevent and allow the movable member to move from its second position towards its first position.

Advantageously, the locking mechanism and the controller are adapted to prevent removal of the portable coin receptacle during the dispensing by keeping the movable member in its second position (closed state). This both improves security (by preventing manipulation of the internal parts of the apparatus, including the dispensers, and making the dispensed coins inaccessible) and enhances operational reliability (by preventing dust, dirt or other foreign matter from entering the internal parts of the apparatus while it is running a dispensing operation, and by preventing a coin jam situation that could occur if the portable coin receptacle would be suddenly removed during dispensing).

Moreover, in one or more embodiments, the locking mechanism and the controller are adapted to require positive identity verification of a user (for instance in the form of verified data as read from a personal data carrier and/or input by the user in a user interface of the apparatus in the beginning of a coin dispense operation). Only once the identity of the user has been verified, and his authority to perform a dispense operation thereby has been confirmed, will the controller and the locking mechanism allow the movable member to be moved to its first position, in which the closeable dispense space is in its open state and the user may place his portable coin receptacle therein.

In one or more embodiments, the movable member is embodied as a drawer, wherein the first position is a position where the drawer is extended outwardly from the cabinet, and wherein the second position is a position where the drawer is retracted inside the cabinet.

A first sensor may be coupled to the controller and be positioned and adapted to detect when the movable member is in the second position.

Furthermore, a second sensor may be coupled to the controller and be positioned and adapted to detect the presence of the portable coin receptacle within the closeable dispense space.

In one or more embodiments, which comprise first and second dispensers for first and second types of coins to be dispensed. The portable coin receptacle is advantageously a cash till having first and second compartments adapted to receive coins of the first and second types from the first and second dispensers, respectively.

Such a cash till may or may not have compartments also for notes, etc. In other embodiments, the portable coin receptacle may be constituted by one or more separate or connected coin boxes, coin tubes, coin bags, etc, with or without appropriate holder or guide means within the closeable dispense space for accurate positioning with respect to the dispensers.

The apparatus may further comprise a coin acceptance module adapted to receive and sort a deposited mass of coins into the first and second dispensers for buffering therein. Such an apparatus thus constitutes or forms part of a cash recycling system.

One or more embodiments may further comprise a closeable storage space within the cabinet, separated from the closeable dispense space and being adapted to receive a transport container, wherein the controller is configured to control at least one of the first and second dispensers to discharge one or more coins to the transport container when placed in the closeable storage space.

This arrangement allows for efficient and automatic relief of a situation when a particular dispenser has buffered so many coins (as deposited and sorted by the coin acceptance module) that it approaches a state of overfilling. More particularly, a buffer capacity determining mechanism may be provided for each dispenser, wherein the controller will be adapted to detect when a current buffer capacity of a particular dispenser (e.g. the current amount, volume or level of coins in the particular dispenser) exceeds a threshold value and in response control the particular dispenser to discharge a specific number of coins to be received in the transport container. Thus, this arrangement provides a controlled balancing of the fillness of the dispensers, such that any excessive coins are discharged to the transport container rather than causing an interruption of the apparation operation due to overfilling of one of the dispensers. Excessive coins may be accumulated in the transport container, which conveniently may have a large storage capacity and be safely accommodated within the closeable storage space, waiting for the arrival of an authorized person, such as a CIT (Cash In Transit) person, to ultimately empty or collect the transport container.

The buffer capacity determining mechanism may for instance be implemented as a dedicated capacity sensor for each dispenser. Alternatively, the controller may implement the determination of buffer capacity by keeping continuous track of the different types of coins deposited, processed in the coin acceptance module and buffered in the respective dispensers.

The controller may be adapted to detect that a coin as processed by the coin acceptance module and destined to a particular dispenser causes the current buffer capacity of the particular dispenser to exceed the threshold value, and in response control the particular dispenser to discharge a coin to the transport container.

In one or more embodiments, the closeable storage space is formed by a movable and closeable transport container drawer. In an opened, extended position the container drawer is adapted to receive the transport container and in a closed, retracted position, the container drawer is adapted to accommodate the transport container and prevent it from unauthorized external access.

The closeable dispense space may be positioned between the dispensers and the closeable storage space. A passage is formed from a coin output end of the dispensers, through the closeable dispense space when no portable coin receptacle is present therein, to a coin input end of the closeable storage space.

Thus, when no portable coin receptable is present in the closeable dispense space (i.e. when the apparatus is currently not used for a dispensing operation), the closeable dispense space may be used as an intermediate channel through which coins can be forwarded from any of the dispensers to the transport box. This has an advantage in terms of apparatus size; the closeable dispense space is used for two different purposes—as receiving area for the portable coin receptable during a dispense operation, and as forwarding channel to the transport box during a deposit operation.

Access restricting means may be positioned between the closeable dispense space and the closeable storage space. The access restricting means prevents visual and human physical access from the closeable dispense space into the closeable storage space while permitting coins to pass therethrough into the transport container. This gives a further improved security.

It is to be noticed that there are no particular limitations as regards the specific composition of coins which is dispensed to the portable coin receptacle. Generally, any combination of coins of one or more types (such as one or more denominations of coins from one or more currencies) and in one or more amounts is possible. The dispensers are not limited to a particular number, and there are no particular limitations in the relation between the number of dispensers, what types of coins they handle, and how such types of coins are received in the portable cash receptacle.

Moreover, the term "coins" is to be interpreted as encompassing monetary coins but also similar value-representing objects such as markers or tokens.

A second aspect is a coin deposit and dispensing apparatus comprising a cabinet serving as an apparatus housing for the apparatus, a controller, a coin acceptance module adapted to receive and process a deposited mass of coins, and one or more dispensers for one or more types of coins to be dispensed. In a deposit operation, the dispensers are adapted to receive the deposited and processed mass of coins for buffering therein. In a dispensing operation, the dispensers are adapted to dispense a specific composition of coins, under control by the controller, to a portable coin receptacle at a dispense location. The apparatus has a closeable storage space positioned within the cabinet at a storage location different from the dispense location. The closeable storage space is adapted to receive a transport container. The controller is configured to control at least one of the first and second dispensers to discharge one or more coins to the transport container when placed in the closeable storage space.

Buffer capacity determining mechanism may be provided for each dispenser.

The controller may be adapted to detect that a coin as processed by the coin acceptance module and destined to a particular dispenser causes the current buffer capacity of the particular dispenser to exceed the threshold value, and in response control the particular dispenser to discharge a coin to the transport container.

The closeable storage space may be formed by a movable and closeable transport container drawer, which in an opened, extended position is adapted to receive the transport container and in a closed, retracted position is adapted to accommodate the transport container and prevent it from unauthorized external access.

The apparatus of the second aspect may have a closeable dispense space at the dispense location within the cabinet for receiving the portable coin receptacle during the dispense operation. The closeable dispense space is positioned between the dispensers and the closeable storage space. A passage is formed from a coin output end of the dispensers, through the closeable dispense space when no portable coin receptacle is present therein during the deposit operation, to a coin input end of the closeable storage space.

Access restricting means may be positioned between the closeable dispense space and the closeable storage space. The access restricting means prevents visual and human physical access from the closeable dispense space into the closeable storage space while permitting coins to pass therethrough into the transport container.

Other objectives, features and advantages of the present invention will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Figure 1:
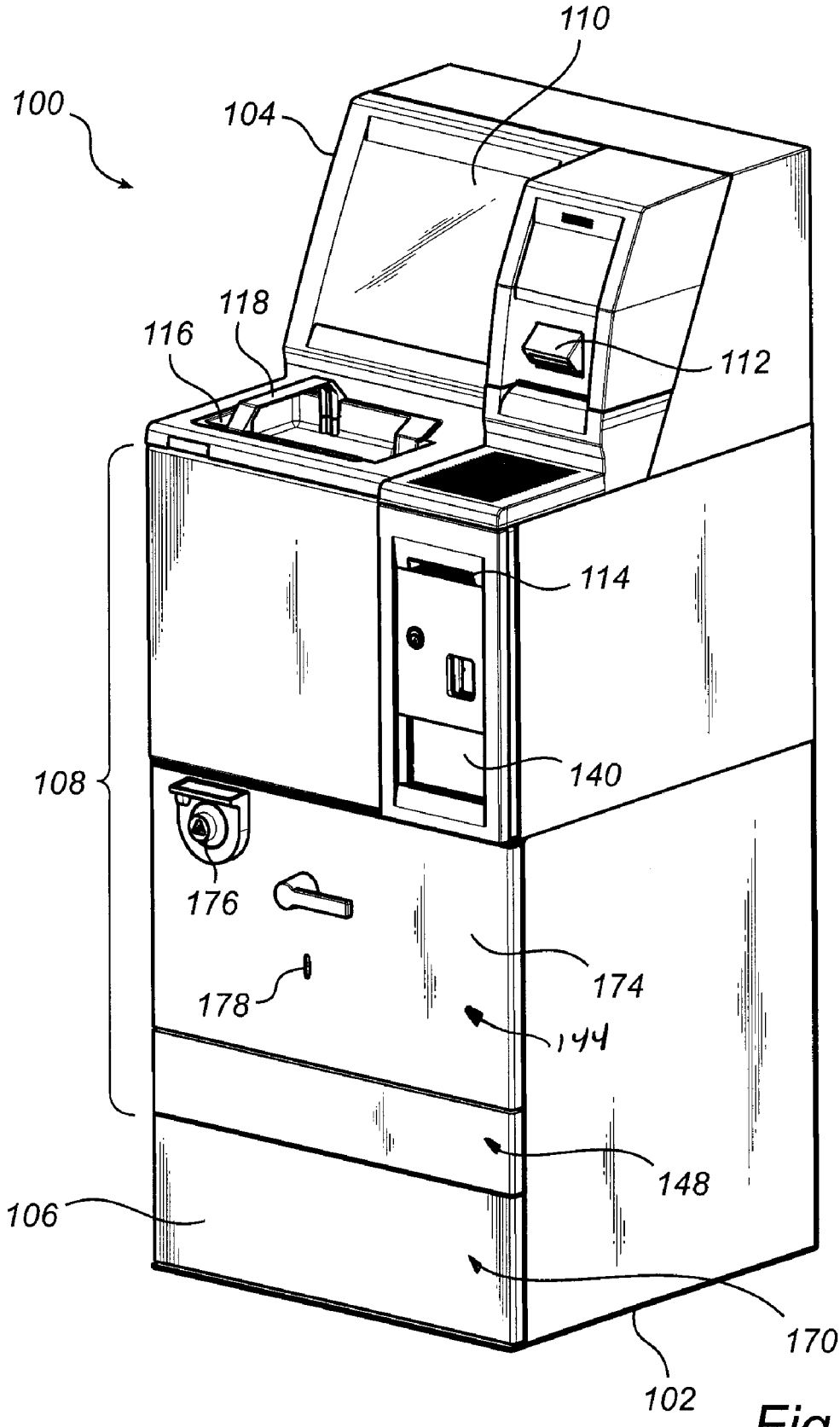
FIGS. 1-4 are perspective front views of a cash deposit and dispensing apparatus according to a first embodiment of the invention.

FIG. 1-10 illustrates a coin deposit and dispensing apparatus 100 (e.g., a coin recycling apparatus) in accordance with a first embodiment of the invention. The apparatus 100 is comprised in a single cabinet 102 and includes several combined modules, each filling one or more specific functions. It is emphasized that the combination of modules, as well as functions within an individual module, described in the following in some detail with reference to the drawings is not the only possible alternative. Modules and functions within individual modules can be added, altered, and excluded without leaving the inventive concept as defined by the appended claims.

The apparatus 100 generally consists of three main modules: a user interface module 104 at the top of the apparatus 100, a cash storage module 106 at the bottom of the apparatus, and a cash processing module 108 there between. These modules 104, 106, 108 are divided into submodules and will be described in the following.

The purpose of the apparatus 100 is to simplify and render more effective the handling of cash in general and coins in particular. Instead of sending all incoming coins from customers to a remote bank or CIT company and thereafter receiving coins for daily operation from the same bank, etc., the apparatus 100 renders it possible to recirculate or recycle coins from customers to the highest possible extent. This reduces costs related to CIT operations and work related to handling and maintenance. Further, the apparatus 100 simplifies the daily handling of coins. The apparatus 100 according to the first embodiment of the invention has two main operations: coin deposit (where coins are input by a user and then counted, sorted and buffered) and coin dispensing (where coins buffered in the apparatus are dispensed to a user).

The user interface module 104 has a touch-sensitive display screen 110 ("touch screen" in the following) through which the user may communicate with the apparatus; instructing it what to do as well as receiving useful information. This module also has a card reader 112, used for identification purposes, and a printer 114 for printing receipts, statistics and such. A controller e.g. a CPU (not shown), is located within the cabinet 102, behind the screen 110. In this embodiment, the controller serves as a central controller unit for the entire apparatus 100, including the coin processing module 108. Other embodiments may however use one or more local controllers in some or all of the modules of the apparatus, such local controllers being configured to cooperate as required. Obviously the user interface module 104 can comprise any useful feature commonly used, such as input keys, a bar code reader, a speaker, a microphone and other I/O devices. A user, such as a cashier by the end of a shift, will log on by inputting certain identification data. This may involve entering a personal code on the touch screen 110 and/or feeding a personal data carrier to the card reader 112 (such as a magnetic card, a smart card, an electronic ID-tag, etc.)

When depositing coins the user empties a portable coin receptacle, e.g., a till 146 (FIG. 8), into a coin input tray 116. The till 146 may be used in a cash register (not shown) for storing coins received from a customer during a commercial transaction and providing coins for a cashier to use for change during the commercial transaction. The contents of such a till can be a mixed mass of coins, valid as well as invalid, as well as other foreign material such as paper clips, dust etc. Note that valid coins could include more than one currency (including tokens, jubilee coins, gift coins and such). The end-user may then tilt the tray 116 by lifting it by the handle 118, thereby causing the contents to slide down the bottom surface of the tray 116 and into the interior of the cash processing module 108.

Figure 2:
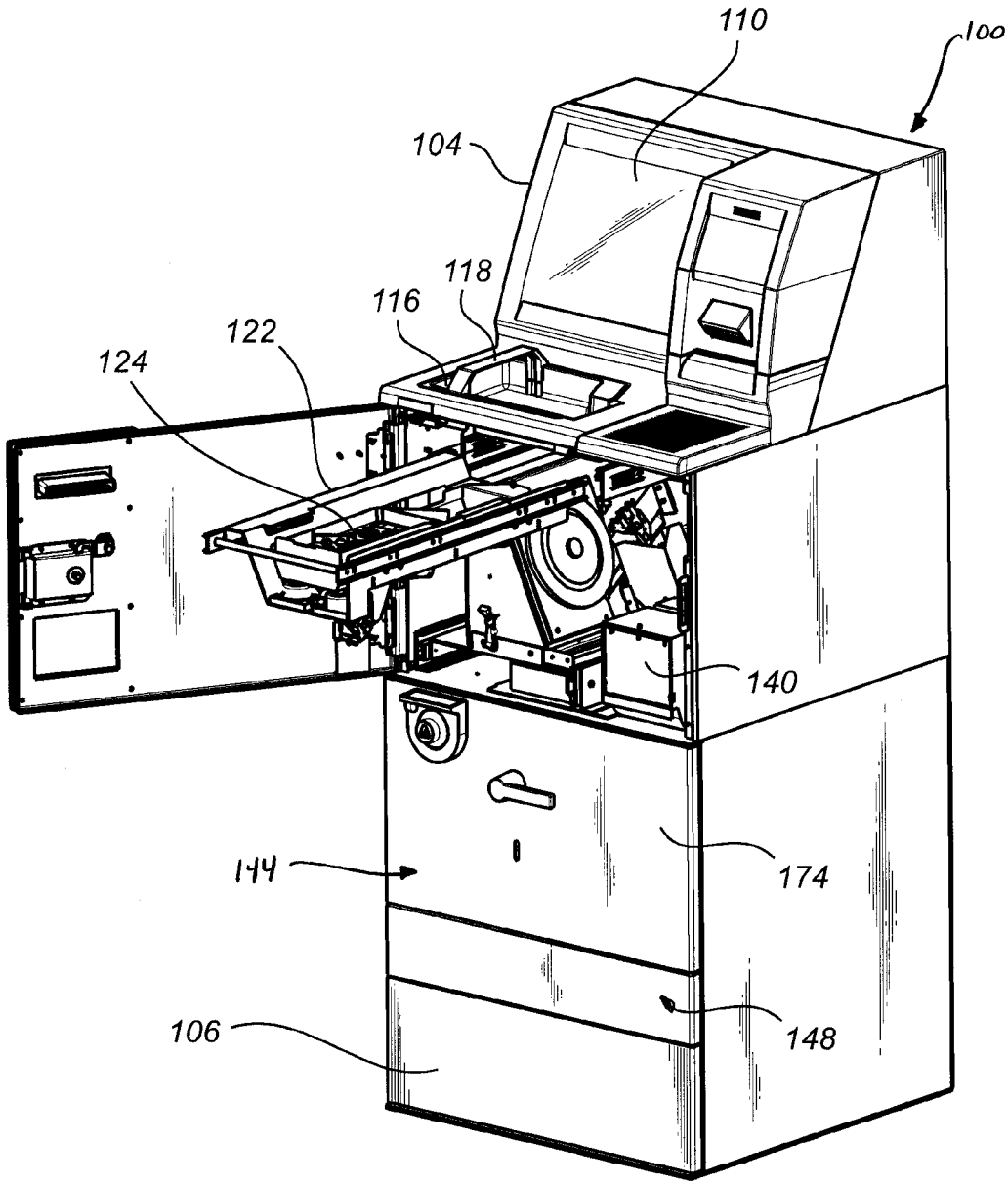

In the cash processing module 108 the contents first passes an automatic coin conditioning (ACC) unit 122. This unit is shown in greater detail in FIG. 2. Like most of the other submodules the ACC-unit 122 is slidably arranged on a pair of rails so that it can be retractably pulled out from the interior of the cabinet. In FIG. 2 the ACC-unit 122 is shown in the pulled-out state. The ACC-unit involves a vibratory arrangement of perforated plates 124. This arrangement will separate foreign matter from the mass of coins. When the cash has been conditioned in the ACC it is forwarded to a cash acceptance module (CAM) 126.

Figure 3:
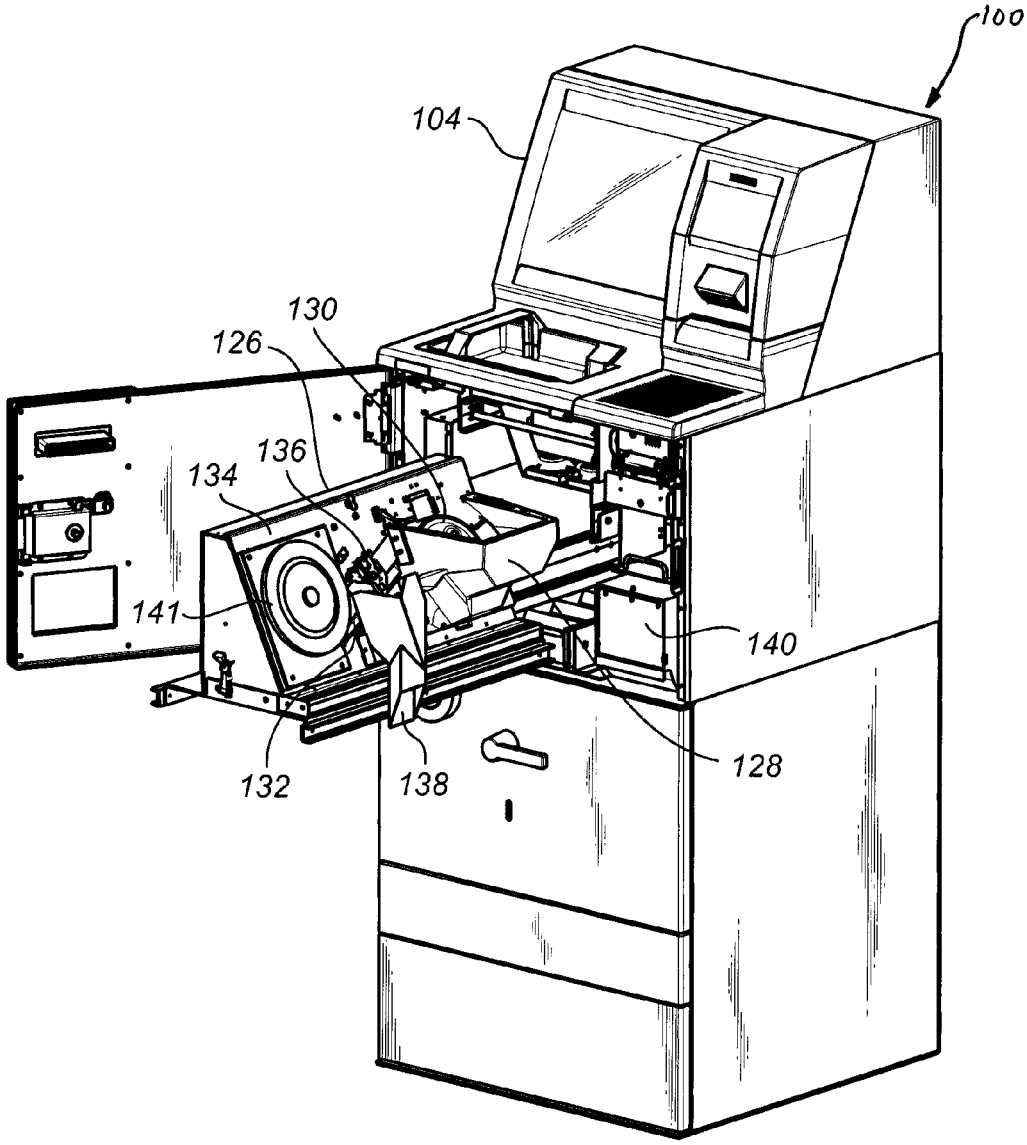
Figure 4:
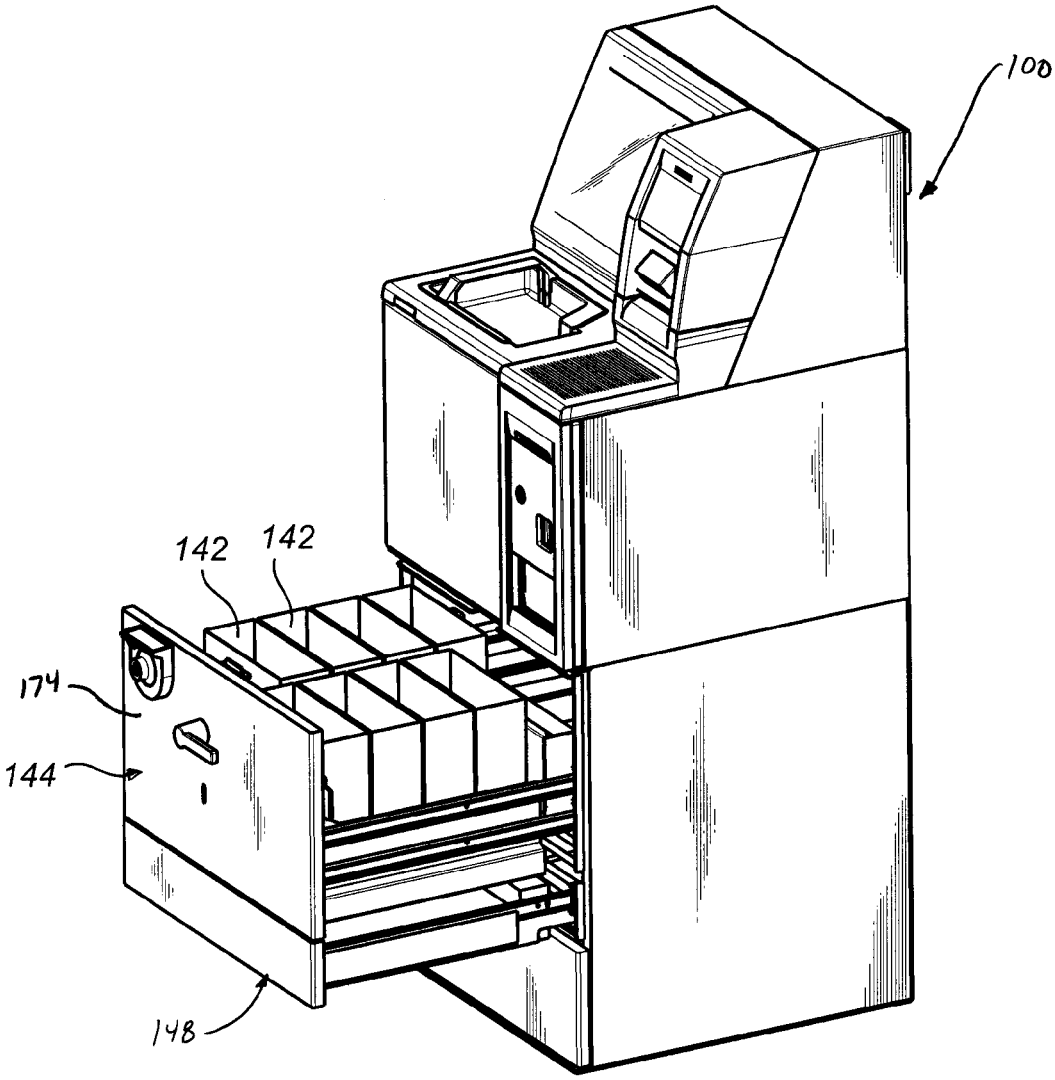

The cash acceptance module 126 is shown in greater detail in FIG. 3, in a pulled-out state, similar to the ACC-unit of FIG. 2. One purpose of the CAM 126 is to separate valid coins from invalid ones. The CAM 126 also serves the purpose of determining the type (e.g. denomination) of the valid coins, to count the number of valid coins of each type (denomination), and to sort them, thus enabling full control of transactions occurring thus far in the apparatus 100. The ACC 122 forwards the conditioned coins to a hopper bowl 128 via a receiving tray (not shown). A rotary flexible disc 130 is provided in the hopper bowl 128 and acts to pick up individual coins and bring them to the beginning of a downwardly sloping coin rail 132, mounted to a backwardly inclined front plate 134 of the CAM 126. Each coin will roll, by gravity, down the coin rail 132 and past a coin sensor unit 136.

The coin sensor unit 136 will detect certain physical properties of the passing coin, such as conductivity, permeability, diameter and thickness, and compare these to prestored coin reference data in a memory by way of a processor in or coupled to the CAM 126. If the comparison fails to identify the coin as a coin of a valid denomination, it will be regarded as invalid and be deflected through a reject channel 138 to a cash reject area 140.

If on the other hand a valid denomination has been established for the coin, its denomination or associated value will be recorded for later use when calculating a total value for all valid coins processed during the coin deposit transaction upon its completion.

Valid coins roll down the rail 132 and are transported by a rotary carrier disc 141 along a circular sorting path across a series of openings in the front plate 134. The openings are of increasing size, such that coins of the smallest diameter will fall down through the first opening in the transport direction, whereas coins of the second smallest diameter are separated through the next opening, etc. A channel system (not shown) at the back of the front plate 134 will guide the thus sorted coins into correct dispensers 142 of a dispenser unit 144, best seen in its pulled-out state in FIG. 4.

Note that valid coins could include more than one currency, e.g. a retail establishment could accept more than one currency (including tokens, jubilee coins, gift coins and such) as payment from its customer. The change given back to a customer, however, usually includes a single currency. This means that the CAM accepts coins that are not to be dispensed at a later stage. These latter coins can be stored in separate dispensers 142 (by denomination/type), a single dispenser 142 or be bypassed directly or indirectly to a transport container/transport box 170. The number of coins, as well as their denomination, is registered by the controller before they enter the dispensers.

Figure 5:
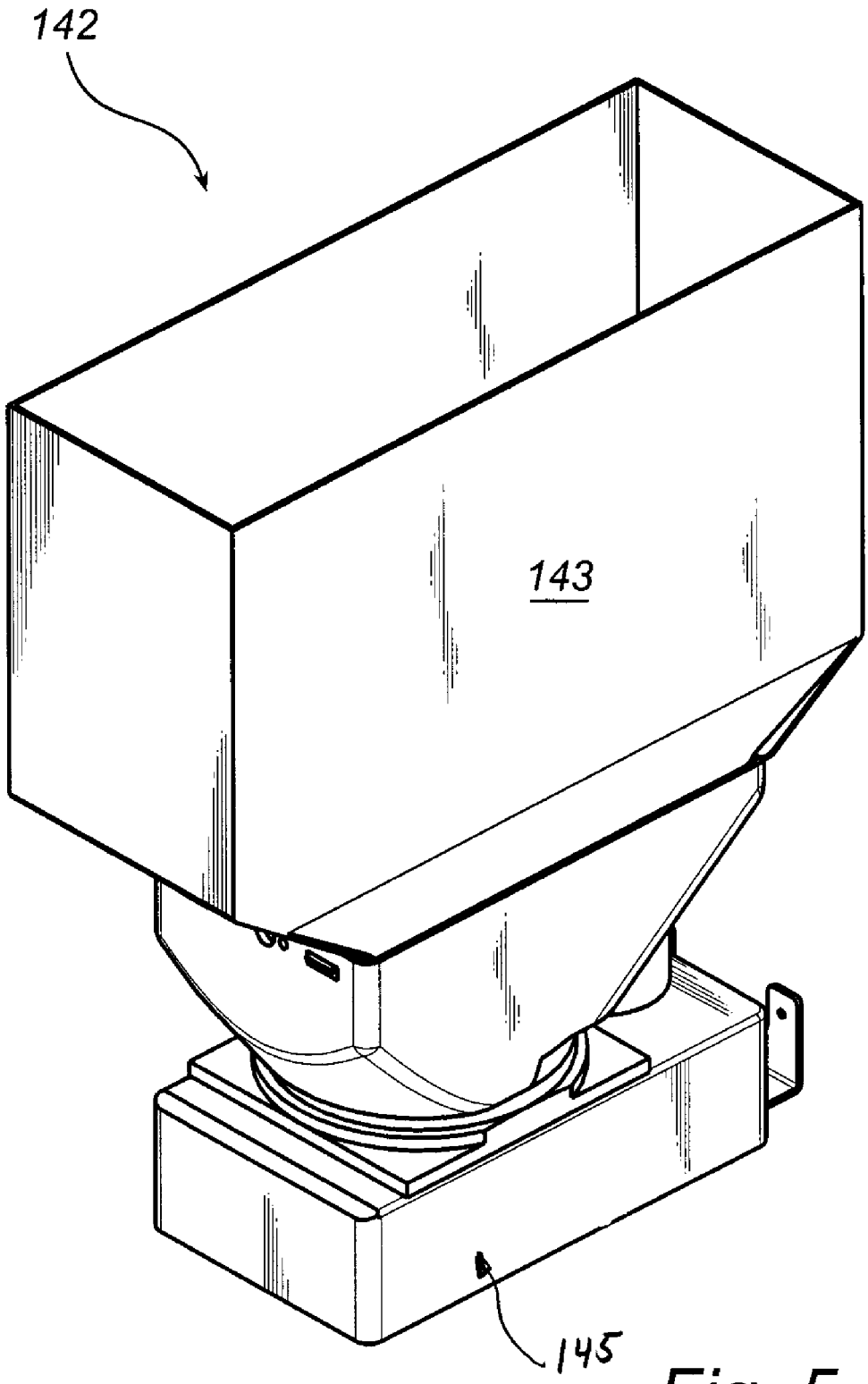
FIG. 5 is a perspective view illustrating a coin dispenser used in the first embodiment of the invention.

As visualised in FIG. 5 an individual dispenser 142 comprises two main parts, a buffer container 143 (the visible part of the dispensers 142 in FIG. 4) and a ejector/counter 145, which may be of any type known per se, such as electromechanical or pneumatic. Each dispenser 142 communicates with the controller. Each dispenser 142 has a buffer capacity associated with a threshold value, usually referring to the number of coins it is allowed to contain. If, during a deposit procedure, the threshold value is reached, the coin ejector 145 associated with the dispenser 142 will typically eject one coin for each coin the dispenser 142 receives above the threshold value. The ejected coins will then fall into the transport box 170. The transport box 170 is located in the cash storage module 106 at the bottom of the cabinet 102 and will be described is further detail herein.

The dispensing operation will now be described.

When the user wishes to fill a portable coin receptacle, in this particular embodiment, a till 146 with several coin compartments (see FIG. 8), with coins, at the start up of shift, the user logs on like before by using the touch screen and personal card. Codes and cards are verified and access is granted. After choosing the dispense function, the controller controls an extendible till drawer 148 to be ejected from the cabinet 102, see FIG. 7. The drawer 148 itself is a movable member providing a closeable dispense space and could as such be replaced with a hatch or the like in other embodiments. In one embodiment, the drawer 148 is a standard type metal sheet drawer with a reinforced steel front. The drawer 148 has a hole 150 in the bottom surface, which allows coins to fall past the drawer 148 into the transport box 170 in the absence of a till 146 being placed in the drawer. The bottom of the drawer also comprises guide means 152 in order to localise the till 146 in the drawer. The user places the till 146 in the drawer 148, see FIG. 8, and closes it by pushing it back into the cabinet 102. The drawer 148 will then be automatically locked in its closed position by means of an electromechanical locking mechanism.

Figure 9:
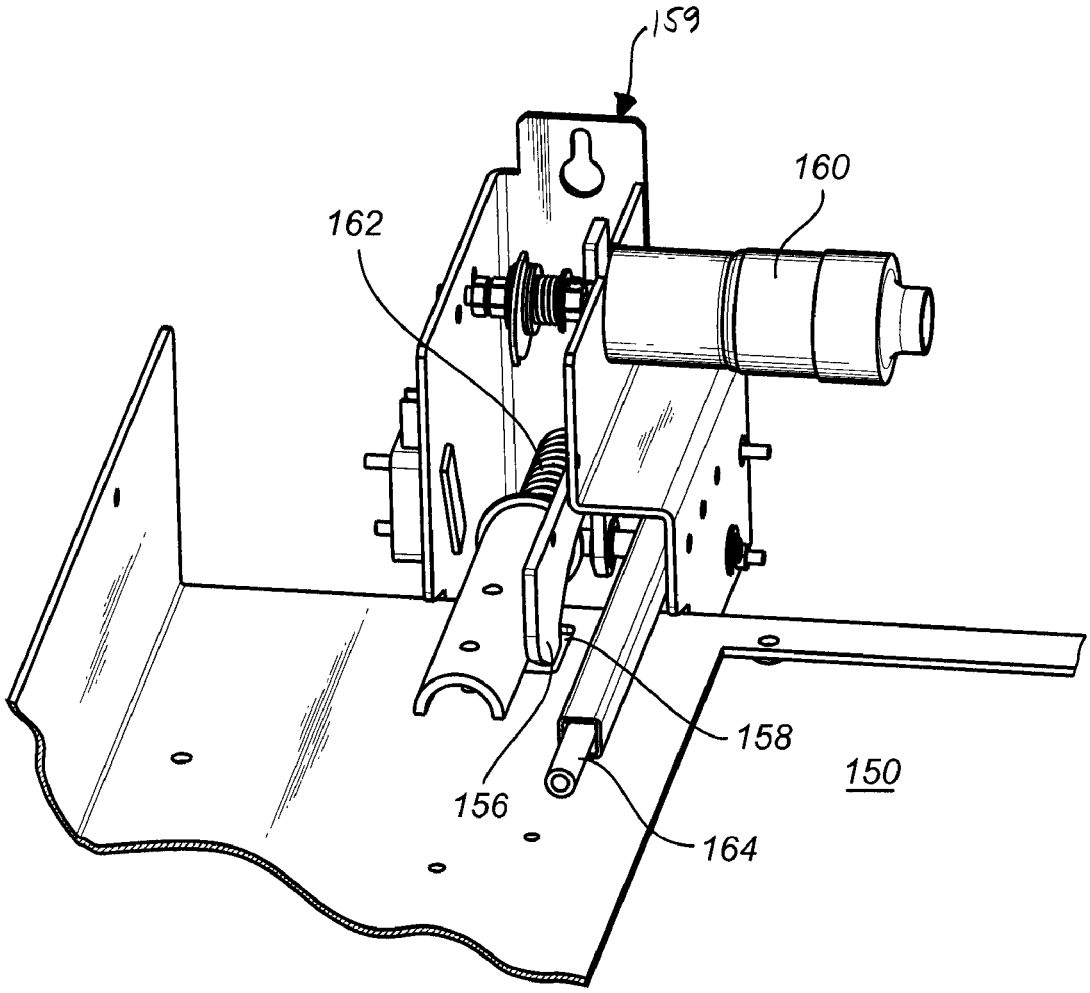
FIG. 9 is a detailed, partial perspective view of a locking mechanism used for the first embodiment of the invention.

The drawer 148 itself is supported by a telescopic rail 154, attached to the inside of the cabinet, in a standard fashion and similar to the other pull-out units. One type of drawer ejection/locking mechanism 159 is shown in FIG. 9, though several different possible systems are anticipated. In FIG. 9, the locking mechanism 159 comprises a latch 156 that engages an opening 158 in the inner part of the drawer 148.

When the drive 160 of the locking mechanism 159 is commanded to open by the controller, it rotates to push the latch 156 out of engagement with the opening 158. Once the engagement has ceased, the latch 156 will remain in the disengaged position long enough to permit a compressed spring 162 to force the drawer 148 towards the open position, thereby constituting the open state of aforesaid closeable dispense space. In some implementations, manual assistance may be required from the user to pull the drawer 148 to a fully extended position. The latch 156 is biased towards the locked position so that when the force of the drive 160 terminates the latch will 156 return to the locked position. The user places the till 146 in the drawer 148 and pushes the drawer to its closed position. As the drawer reaches the latch 156 the latter will be pushed upwardly, permitting the drawer 148 to assume the locked position in which it compresses the spring 162 and constituting the closed state of the aforesaid closeable dispense space. A first sensor then verifies that the drawer is closed and a second sensor 164 verifies that the till 146 is placed in the drawer 148, after which the actual dispensing of coins can be initiated by the controller. After the dispensing is finalised, the drawer is automatically unlocked and ejected. This is governed by the controller and can obviously be altered in accordance with the wishes of a user.

Figure 6:
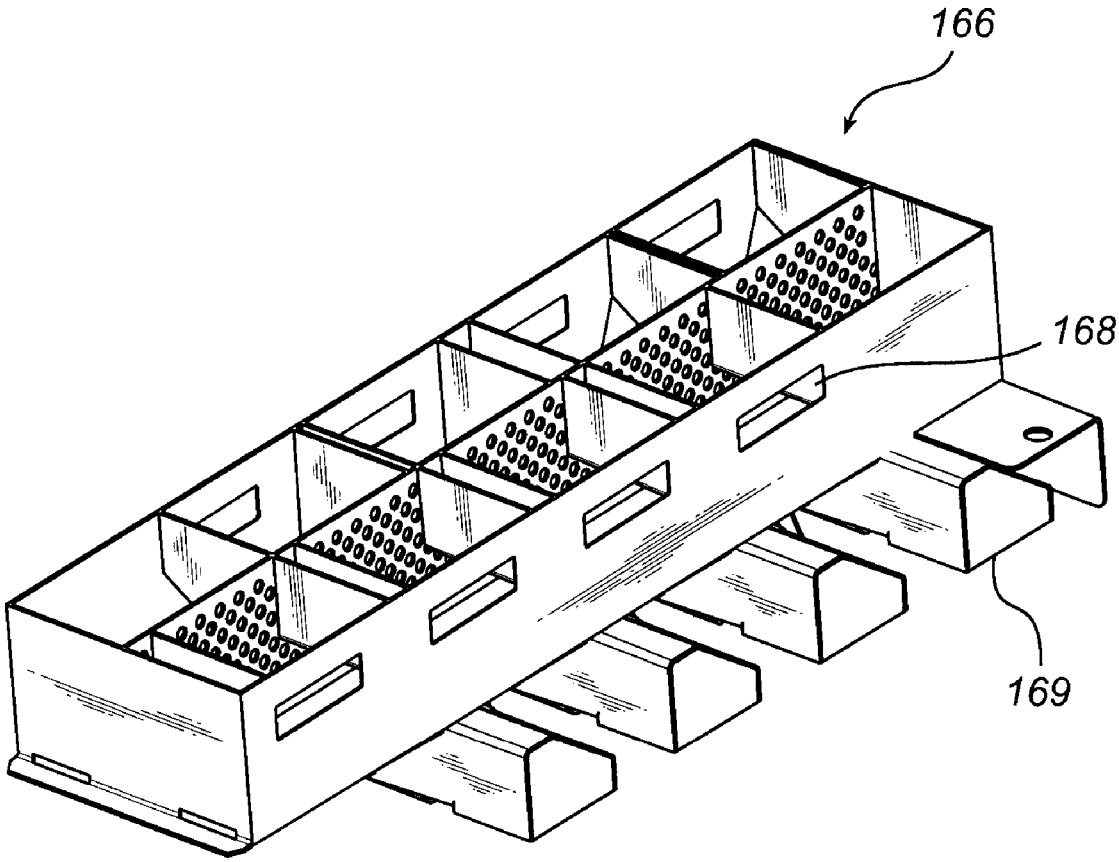
FIG. 6 is a perspective view of a filling distributor used in the first embodiment of the invention.
Figure 7:
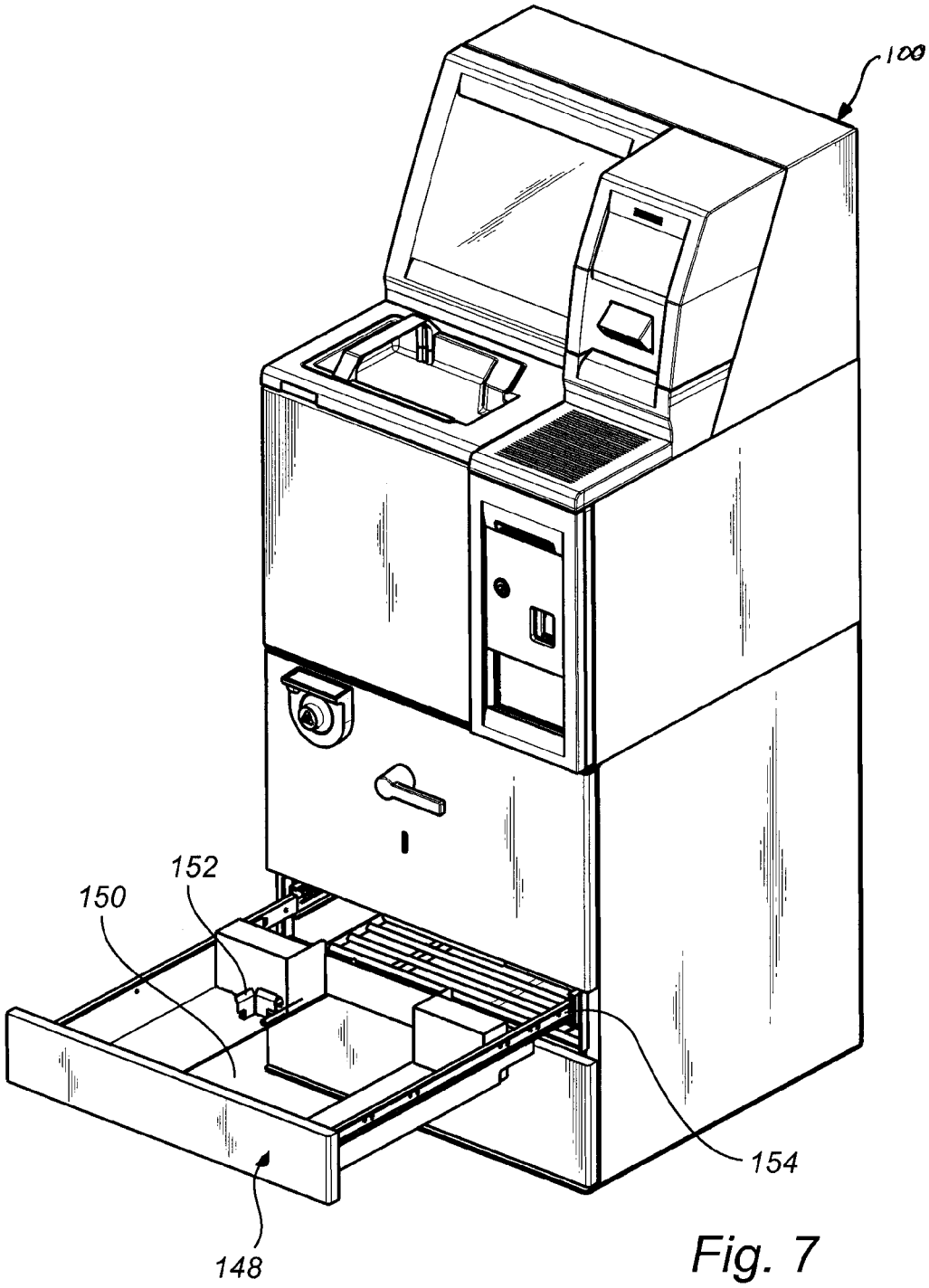
FIGS. 7, 8 and 10 are views similar to FIGS. 1-4.
Figure 8:
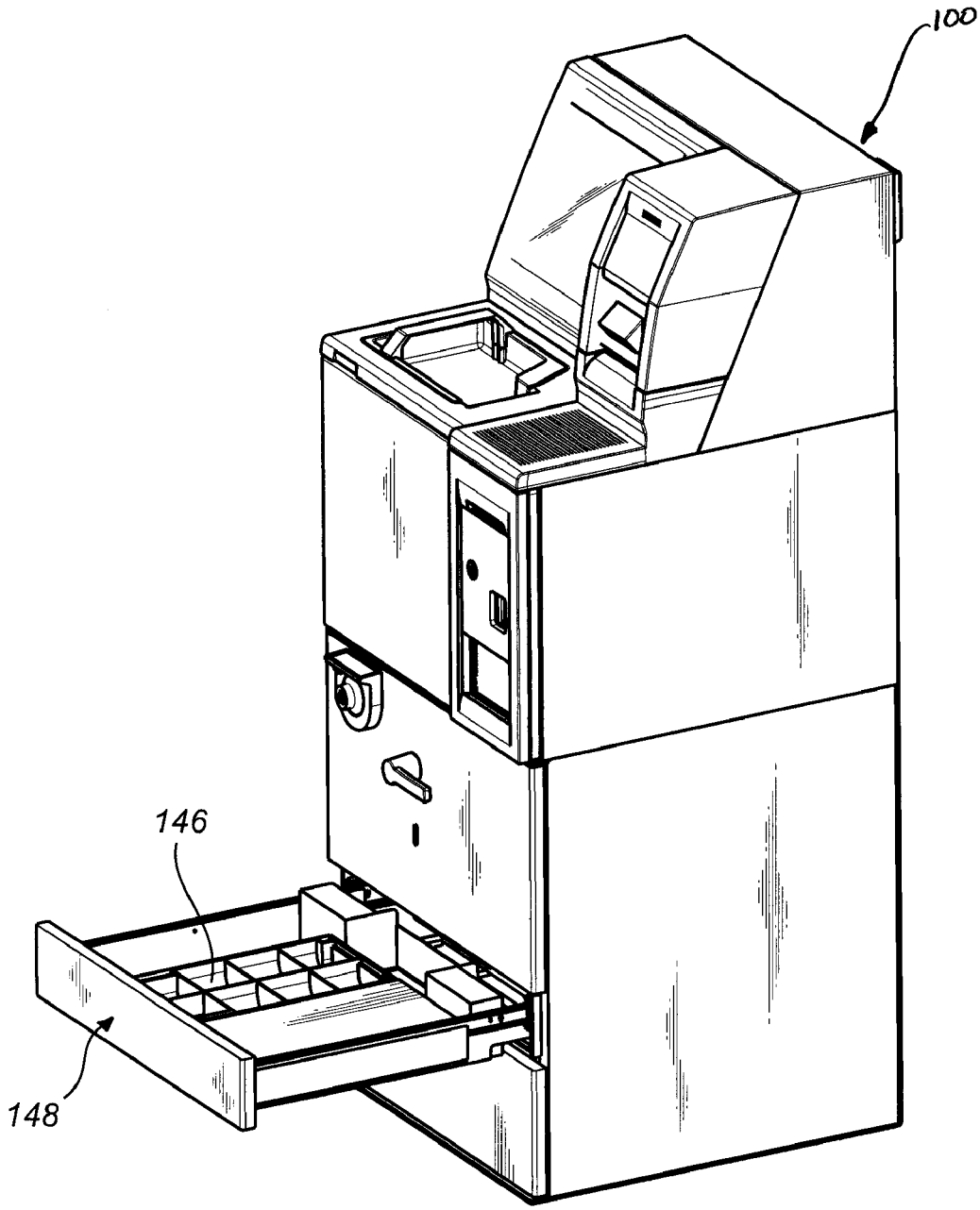

The apparatus 100 is generally customized for one type of till 146 in that a specific filling distributor 166, see FIG. 6, is arranged between the dispensers 142 and the till 146. The filling distributor 166 serves to lead coins from a certain coin ejector 145 to a certain compartment in the till 146. Each ejector 145 is arranged to eject coins into a corresponding hole 168 in the filling distributor 166, which hole 168 in turn is associated with a corresponding channel 169 in the distributor 166. In the first embodiment the ejectors 145 will eject coins with quite high velocity, which is why the partition wall of the dispenser 166 is perforated, see FIG. 6, in order to reduce noise. Each retail system/apparatus can be associated with more than one filling distributor 166 if needed.

Figure 10:
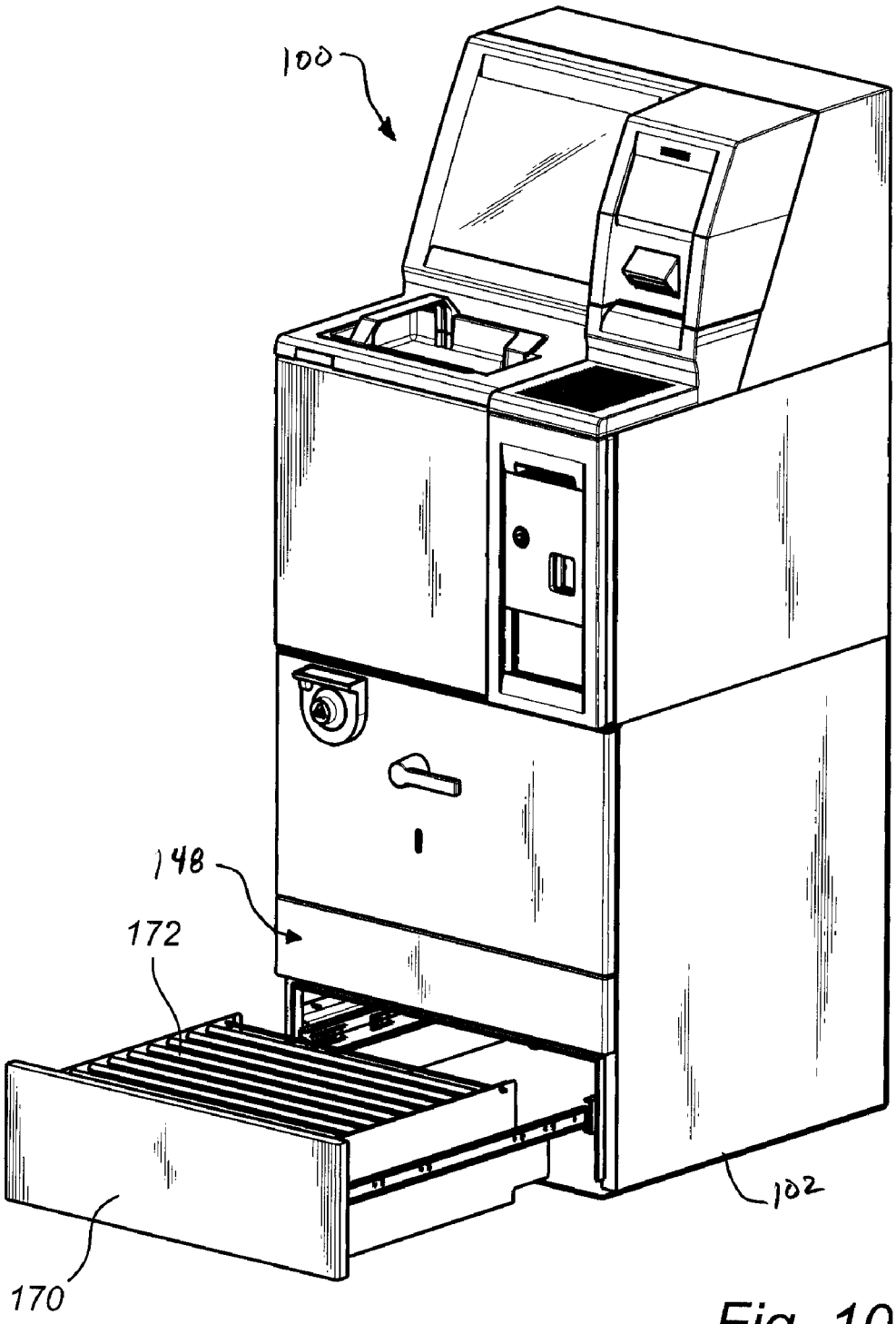

As shown in FIG. 10 the transport box drawer 170 is located in the cabinet 102, below the till drawer 148. To prevent unauthorized personnel, in this case personnel that are allowed to access the till drawer 148 but not the transport box drawer 170, from accessing the transport box drawer 170 via the till drawer 148 (see FIG. 7), access restricting components are arranged. These access restricting components include a steel curtain 172 above the transport box drawer 170. The steel curtain comprises an arrangement of steel gills inclined upwardly, away from an opening direction of the till drawer 148, preventing human visual and physical access to the transport box drawer 170 while allowing coins to pass into the latter. To collect coins dispensed into the transport box drawer 170, any suitable type of storage device may be arranged therein.

Access to the transport box drawer 170 is permitted for selected personnel only. In practise only personnel from a CIT company can access the transport box. The same personnel can also instruct the system to empty the whole contents of the dispensers 142 into the transport box drawer 170. This may be desired when the apparatus 100 is to be physically moved, reconditioned or similar.

Access to the various modules is generally differentiated. The day to day user can access the till drawer 148 only. This access is permitted after the user has logged on and after the verification of a personal card. The access to the coin dispensers 142 is generally restricted to a few individuals. The coin dispenser door 174 is opened with a security lock 176 code and a key inserted in a key hole 178. In the first embodiment of the invention a ledge on the upper part of the till drawer 150 prevents the dispenser drawer 144 from being opened. This makes it more difficult for unauthorized personnel to access the interior of the cabinet. When the dispenser drawer 144 is correctly accessed the till drawer 150 will also be unlatched to permit opening.

According to a second embodiment (not shown) the arrangement for receiving the till may be of a prior-art type, i.e., with a non-closeable dispense space in the form of a ledge/recess or similar. According to this embodiment the invention concerns a cash deposit and dispensing apparatus provided with a transport box according to the description above.

Figure 11:
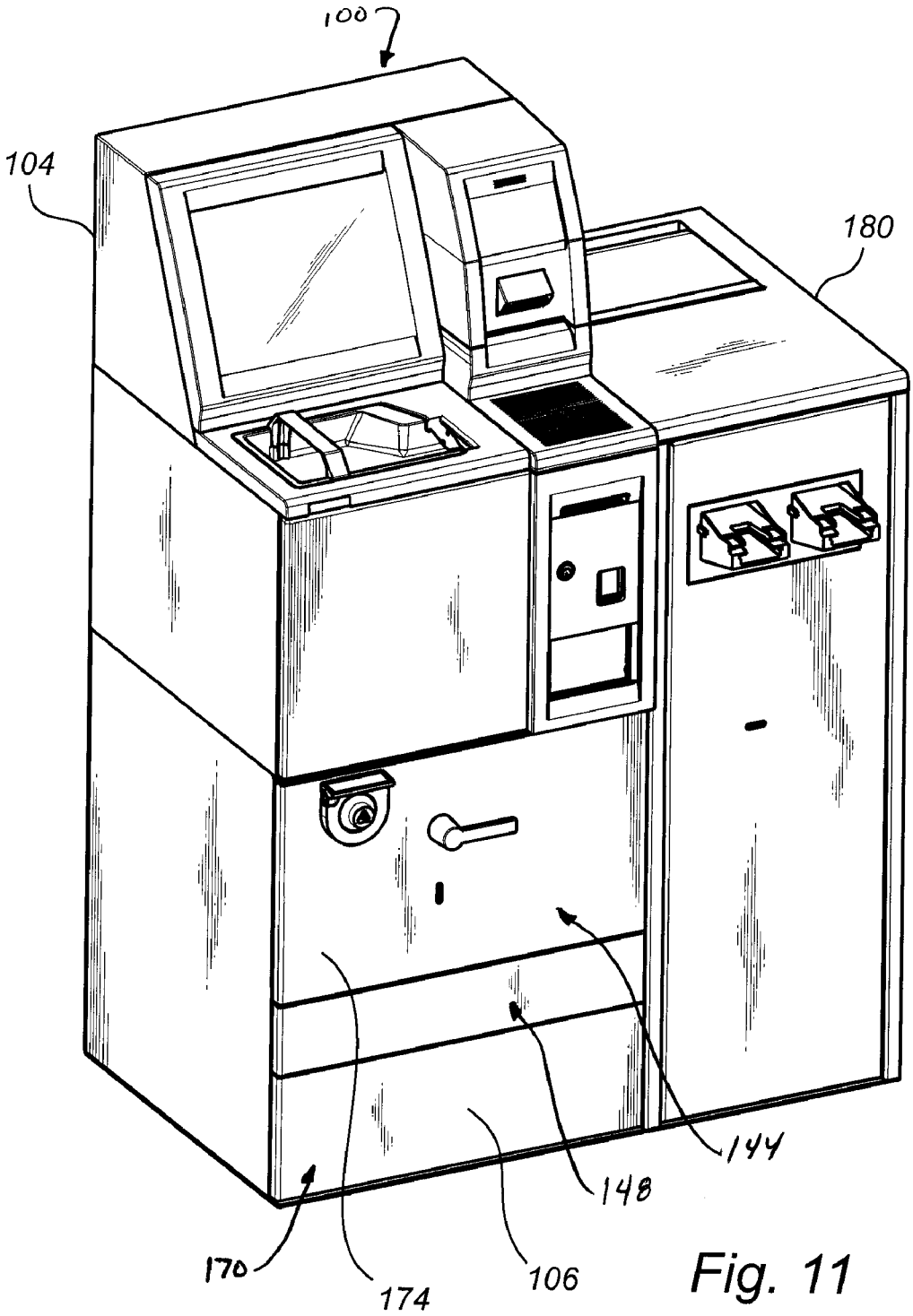
FIG. 11 is a front perspective view of a third embodiment of the invention.

In a third embodiment, see FIG. 11, the apparatus of the first or second embodiment is combined with a note module 180 for the handling of notes (bills). The note module 180 is designed according to prior art and has note depositing and dispensing capabilities. The addition of a note module 180 widens usability of the inventive apparatus.

In use, the coin recycling apparatus 100 is for utilizing a method of recycling coins to reduce or eliminate the need for a retail establishment to receive coins from a remote bank or CIT company. A first plurality of coins is deposited into the coin recycling apparatus 100 such as by emptying the contents of a portable cash receptacle (e.g., a till 146) at the end of a cashier's shift. The coins emptied from the till 146 are processed in the cash processing module 108 and the cash acceptance module 126 of the apparatus 102. As noted above, the processing in the cash processing module 108 may include separating foreign matter from the coins. The processing in the cash acceptance module 126 may include separating valid coins from invalid coins, counting the number of valid coins of each denomination, and sorting the valid coins.

At the beginning of a cashier's shift, a portable cash receptacle (e.g., a till 146) to be used by the cashier can be filled with a specific composition of coins to be used to make change during the commercial transactions between the cashier and customers. The till drawer 148 is opened to allow the user to place the till 146 into the drawer. The drawer 148 is closed to prevent user access to the till received therein. As noted above, after closing the drawer 148, the dispensers 142 dispense the desired specific composition of coins into the till 146 held in the drawer 148. After the coins have been dispensed, the drawer 148 is opened to allow the cashier to remove the till 146 and proceed with commercial transactions with customers.

The recycling apparatus 100 of the present invention reuses coins deposited at the end of a cashier's shift as dispensed coins to be subsequently used by the same or a different cashier in providing change for later commercial transactions with customers.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention

What is claimed is:

1. A coin deposit and dispensing apparatus comprising:

a cabinet;

a controller;

at least one coin dispenser supported within the cabinet, the dispenser configured to dispense a specific composition of coins, under control by the controller, to a cash till; and a closeable dispense space within the cabinet, the closeable dispense space having an open state in which state the dispense space may receive a cash till to be filled, and a closed state, in which state the dispenser may dispense the specific composition of coins from the at least one dispenser into the cash till, the closed state preventing access to the cash till received therein during the dispensing of the specific composition of coins, said apparatus further comprising, a movable member defining at least a partial boundary of the closeable dispense space, the movable member being moveable between a first position corresponding to the open state in which a cash till, which is separate from the movable member, may be received at the dispense space, and a second position corresponding to the closed state, a first sensor coupled to the controller and positioned for detecting when the movable member is in the second position, a locking mechanism coupled to the controller and associated with the movable member, the locking mechanism being controlled by the controller to selectively allow the movable member to move from its second position towards its first position, and a first dispenser and a second dispenser respectively for first and second types of coins to be dispensed, the cash till having first and second compartments to respectively receive coins of the first and second types from one of the first and second dispensers, wherein the movable member comprises a drawer, wherein the first position is a position where the drawer is extended outwardly from the cabinet, and the second position is a position where the drawer is retracted inside the cabinet.

2. A coin deposit and dispensing apparatus comprising:

a cabinet;

a controller;

at least one coin dispenser supported within the cabinet, the dispenser configured to dispense a specific composition of coins, under control by the controller, to a cash till; and a closeable dispense space within the cabinet, the closeable dispense space having an open state in which state the dispense space may receive a cash till to be filled, and a closed state, in which state the dispenser may dispense the specific composition of coins from the at least one dispenser into the cash till, the closed state preventing access to the cash till received therein during the dispensing of the specific composition of coins, said apparatus further comprising, a movable member defining at least a partial boundary of the closeable dispense space, the movable member being moveable between a first position corresponding to the open state in which a cash till, which is separate from the movable member, may be received at the dispense space, and a second position corresponding to the closed state, a first sensor coupled to the controller and positioned for detecting when the movable member is in the second position, a locking mechanism coupled to the controller and associated with the movable member, the locking mechanism being controlled by the controller to selectively allow the movable member to move from its second position towards its first position, a first dispenser and a second dispenser respectively for first and second types of coins to be dispensed, the cash till having first and second compartments to respectively receive coins of the first and second types from one of the first and second dispensers, and a closeable storage space within the cabinet, separated from the closeable dispense space and for receiving a transport container, wherein the controller is configured to control at least one of the first and second dispensers to discharge one or more coins to the transport container when placed in the closeable storage space, wherein the at least one coin dispenser comprises the first dispenser and the second dispenser respectively for first and second types of coins to be dispensed, the apparatus further comprising a coin acceptance module for receiving and sorting a deposited mass of coins into the first and second dispensers for buffering therein.

3. The apparatus of claim 2 further comprising a buffer capacity determining mechanism for each dispenser, the mechanism comprising the controller detecting when a current buffer capacity of a particular dispenser exceeds a threshold value and, in response, controlling the particular dispenser to discharge a specific number of coins to be received in the transport container.

4. Apparatus according to claim 3 wherein the controller detects that a coin as processed by the coin acceptance module and destined to a particular dispenser causes the current buffer capacity of the particular dispenser to exceed the threshold value, and in response, controls the particular dispenser to discharge a coin to the transport container.

5. The apparatus of claim 2 wherein the closeable storage space is formed by a movable and closeable transport container drawer that is moveable between an extended position and a retracted position, in the extended position the drawer receives the transport container and in the retracted position the drawer prevents unauthorized external access to the transport container received therein.

6. The apparatus of claim 2 wherein the closeable dispense space is positioned between the dispensers and the closeable storage space, a passage is formed from a coin output end of the dispensers, through the closeable dispense space when no cash till is present therein, to a coin input end of the closeable storage space.

7. The apparatus of claim 6, further comprising access restricting components positioned between the closeable dispense space and the closeable storage space, the access restricting components preventing access from the closeable dispense space into the closeable storage space while permitting coins to pass therethrough into the transport container.

8. A coin deposit and dispensing apparatus comprising:

a cabinet housing the apparatus;

a controller;

a coin acceptance module for receiving and processing a deposited mass of coins;

at least one dispenser for at least one type of coin to be dispensed, wherein in a deposit operation, the at least one dispenser is for receiving the deposited and processed mass of coins for buffering therein, and in a dispensing operation, the dispenser is for dispensing a specific composition of coins, under control by the controller, to a portable coin receptacle at a dispense location;

a closeable storage space positioned within the cabinet at a storage location different from the dispense location, the closeable storage space being for receiving a transport container, wherein the controller is configured to control the at least one dispenser to discharge one or more coins to the transport container when placed in the closeable storage space;

a movable member defining at least a partial boundary of a closeable dispense space including the dispense location, the movable member being moveable between a first position corresponding to an open state in which state a portable coin receptacle, which is separate from the movable member, may be received into said dispense location, and a second position corresponding to a closed state, wherein said movable member is retracted inside said cabinet during the closed state;

a sensor coupled to the controller and positioned for detecting the presence of the portable coin receptacle within the closeable dispense space; and a locking mechanism coupled to the controller and associated with the movable member, the locking mechanism being controlled by the controller to selectively allow the movable member to move from its second position towards its first position.

9. The apparatus of claim 8 further comprising a buffer capacity determining mechanism for each dispenser, the mechanism comprising the controller detecting when a current buffer capacity of a particular dispenser exceeds a threshold value and, in response, controlling the particular dispenser to discharge a specific number of coins to be received in the transport container.

10. Apparatus according to claim 9 wherein the controller is for detecting that a coin as processed by the coin acceptance module and destined to a particular dispenser causes the current buffer capacity of the particular dispenser to exceed the threshold value, and in response, controlling the particular dispenser to discharge the coin to the transport container.

11. The apparatus of claim 8 wherein the closeable storage space is formed by a movable and closeable transport container drawer, which is moveable between an opened, extended position wherein the drawer receives the transport container and a closed, retracted position wherein the drawer prevents access to the transport container received therein.

12. The apparatus of claim 8 further comprising a closeable dispense space at the dispense location within the cabinet for receiving the portable coin receptacle during the dispense operation, wherein the closeable dispense space is positioned between the dispensers and the closeable storage space, a passage between a coin output end of the dispensers, and a coin input end of the closeable storage space, the passage allowing coins to pass from the dispensers through the closeable dispenser space to the closeable storage space when no portable coin receptacle is present in the dispenser space.

13. The apparatus of claim 12 further comprising access restricting components positioned between the closeable dispense space and the closeable storage space, the access restricting components preventing access from the closeable dispense space into the closeable storage space while permitting coins to pass therethrough into the transport container.

14. The apparatus of claim 8, wherein the controller is so configured as to prevent dispensing of the specific composition of coins from the dispensers until at least the movable member is detected by the sensor to be present within in the closeable dispense space.

15. A method of recycling coins using a coin recycling apparatus having a coin acceptance module for receiving and processing coins, a first dispenser and a second dispenser respectively for first and second types of coins to be dispensed, the coin recycling apparatus having a cabinet and a closeable dispense space within the cabinet, the closeable dispense space having an open state and a closed state, a movable member defining at least a partial boundary of the closeable dispense space, the movable member being moveable between a first position corresponding to the open state, in which open state a portable cash till, which is separate from the movable member, may be received into the dispense space, and a second position corresponding to the closed state, wherein the movable member is retracted within the closable dispense space in the closed state, and wherein access to any cash till received in the dispense space is blocked during the closed state at least in part by the movable member, a first sensor coupled to the controller and a locking mechanism coupled to the controller and associated with the movable member, the locking mechanism being controlled by the controller, the method comprising:

receiving a plurality of coins into the coin recycling apparatus;

processing the plurality of coins in the coin acceptance module;

with the closeable dispense space in the open state, receiving a cash till having first and second compartments into the closeable dispense space;

detecting, using the first sensor, that the movable member is in the second position;

while the movable member is in the second position, preventing by the locking mechanism user access to the cash till received in the dispense space; and during the preventing step, dispensing a specific composition of coins from the first and second dispensers to the first and second compartments of the cash till, respectively, wherein the closeable dispense space comprises a drawer moveable between a first position corresponding to the open state and a second position corresponding to the closed state, and wherein the recycling apparatus further comprises a closeable storage space within the cabinet and separated from the closeable dispense space, the storage space being for receiving a transport container.

16. The method of claim 15 further comprising determining a buffer capacity for the at least one dispenser, detecting when the buffer capacity of the at least one dispenser exceeds a threshold value, and discharging a corresponding number of coins to the transport container.

17. A coin deposit and dispensing apparatus comprising:

a cabinet;

a controller;

and at least one coin dispenser supported within the cabinet, the dispenser configured to dispense a specific composition of coins, under control by the controller, to a cash till; and a closeable dispense space within the cabinet, the closeable dispense space having an open state in which state the dispense space may receive a cash till to be filled, and a closed state, in which state the dispenser may dispense the specific composition of coins from the at least one dispenser into the cash till, the closed state preventing access to the cash till received therein during the dispensing of the specific composition of coins, wherein the at least one dispenser comprises a first dispenser and a second dispenser respectively for first and second types of coins to be dispensed, the apparatus further comprising a coin acceptance module for receiving and sorting a deposited mass of coins into the first and second dispensers for buffering therein, the apparatus further comprising a closeable storage space within the cabinet, separated from the closeable dispense space and for receiving a transport container, wherein the controller is configured to control at least one of the first and second dispensers to discharge one or more coins to the transport container when placed in the closeable storage space.

18. The apparatus of claim 17 further comprising a buffer capacity determining mechanism for each dispenser, the mechanism comprising the controller detecting when a current buffer capacity of a particular dispenser exceeds a threshold value and, in response, controlling the particular dispenser to discharge a specific number of coins to be received in the transport container.

19. Apparatus according to claim 18 wherein the controller detects that a coin as processed by the coin acceptance module and destined to a particular dispenser causes the current buffer capacity of the particular dispenser to exceed the threshold value, and in response, controls the particular dispenser to discharge a coin to the transport container.

20. The apparatus of claim 17 wherein the closeable storage space is formed by a movable and closeable transport container drawer that is moveable between an extended position and a retracted position, in the extended position the drawer receives the transport container and in the retracted position the drawer prevents unauthorized external access to the transport container received therein.

21. The apparatus of claim 17 wherein the closeable dispense space is positioned between the dispensers and the closeable storage space, a passage is formed from a coin output end of the dispensers, through the closeable dispense space when no cash till is present therein, to a coin input end of the closeable storage space.

22. The apparatus of claim 21, further comprising access restricting components positioned between the closeable dispense space and the closeable storage space, the access restricting components preventing access from the closeable dispense space into the closeable storage space while permitting coins to pass therethrough into the transport container.

23. A method of recycling coins using a coin recycling apparatus having a coin acceptance module for receiving and processing coins and at least one dispenser for dispensing coins, the coin recycling apparatus having a cabinet and a closeable dispense space within the cabinet, the closeable dispense space having an open state and a closed state, the method comprising:

receiving a plurality of coins into the coin recycling apparatus;

processing the plurality of coins in the coin acceptance module;

with the closeable dispense space in the open state, receiving a cash till into the closeable dispense space;

upon closing of the closeable dispense space, preventing user access to the cash till received therein; and during the preventing step, dispensing a specific composition of coins from the dispenser to the cash till, wherein the recycling apparatus further comprises a closeable storage space within the cabinet and separated from the closeable dispense space, the storage space being for receiving a transport container.

24. The method of claim 23 further comprising determining a buffer capacity for the at least one dispenser, detecting when the buffer capacity of the at least one dispenser exceeds a threshold value, and discharging a corresponding number of coins to the transport container.

25. A coin deposit and dispensing apparatus comprising:

a cabinet;

a controller;

at least one coin dispenser supported within the cabinet, the dispenser configured to dispense a specific composition of coins, under control by the controller, to a cash till; and a closeable dispense space within the cabinet, the closeable dispense space having an open state in which state the dispense space may receive a cash till to be filled, and a closed state, in which state the dispenser may dispense the specific composition of coins from the at least one dispenser into the cash till, the closed state preventing access to the cash till received therein during the dispensing of the specific composition of coins, said apparatus further comprising, a movable member defining at least a partial boundary of the closeable dispense space, the movable member being moveable between a first position corresponding to the open state in which a cash till, which is separate from the movable member, may be received at the dispense space, and a second position corresponding to the closed state, a first sensor coupled to the controller and positioned for detecting when the movable member is in the second position, a locking mechanism coupled to the controller and associated with the movable member, the locking mechanism being controlled by the controller to selectively allow the movable member to move from its second position towards its first position, and a first dispenser and a second dispenser respectively for first and second types of coins to be dispensed, the cash till having first and second compartments to respectively receive coins of the first and second types from one of the first and second dispensers, wherein the cash till further comprises a notes compartment and access to the first compartment, the second compartment and the notes compartment of the cash till by the user is prevented when the movable member is in the closed state.

* * * * *